US009155673B2

(12) United States Patent
Bailey

(10) Patent No.: US 9,155,673 B2
(45) **Date of Patent: *Oct. 13, 2015**

(54) URN VAULT

(71) Applicant: Keary D. Bailey, Buda, TX (US)

(72) Inventor: Keary D. Bailey, Buda, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/499,785

(22) Filed: Sep. 29, 2014

(65) Prior Publication Data

US 2015/0013124 A1 Jan. 15, 2015

Related U.S. Application Data

(63) Continuation-in-part of application No. 13/815,507, filed on Mar. 7, 2013, now Pat. No. 8,898,873.

(51) Int. Cl.

| | |
|---|---|
| ***A61G 17/007*** | (2006.01) |
| ***E04H 13/00*** | (2006.01) |
| *A61G 17/08* | (2006.01) |

(52) U.S. Cl.

CPC ..... *A61G 17/007* (2013.01); *E04H 13/00* (2013.01); *E04H 13/008* (2013.01); *A61G 17/08* (2013.01)

(58) Field of Classification Search

CPC ..... A61G 17/00; A61G 17/007; A61G 17/08; E04H 13/00; E04H 13/006; E04H 13/008; C09J 5/00; C08J 5/122

USPC ..... 27/1, 35; 52/128, 138–142; 211/85.27; 156/305, 308.6

See application file for complete search history.

(56) References Cited

U.S. PATENT DOCUMENTS

| | | | | |
|---|---|---|---|---|
| 2,023,260 | A | 12/1935 | Beers et al. | |
| 4,224,602 | A * | 9/1980 | Anderson et al. | 340/321 |
| 4,648,162 | A | 3/1987 | Daino | |
| 5,349,727 | A * | 9/1994 | Niebergall | 27/1 |
| D374,962 | S * | 10/1996 | Allen et al. | D99/5 |
| 5,732,452 | A * | 3/1998 | Riedel, II | 27/1 |
| 6,052,954 | A * | 4/2000 | Dudek et al. | 52/128 |
| 6,076,292 | A | 6/2000 | Kawa | |
| D432,285 | S | 10/2000 | Baldwin et al. | |
| D433,209 | S * | 10/2000 | Baldwin et al. | D99/5 |
| 6,421,890 | B1 | 7/2002 | Biggar | |
| 6,484,457 | B1 * | 11/2002 | Dudek et al. | 52/128 |
| 7,421,765 | B1 * | 9/2008 | Kaiser | 27/1 |
| 7,478,461 | B2 * | 1/2009 | Glass | 27/1 |
| 8,074,328 | B2 * | 12/2011 | Roberts | 27/1 |
| 8,083,275 | B2 * | 12/2011 | Myhre et al. | 294/16 |
| 8,087,132 | B2 * | 1/2012 | Forrest et al. | 27/1 |
| 2005/0125973 | A1 * | 6/2005 | Hankel et al. | 27/1 |
| 2007/0033777 | A1 * | 2/2007 | Blessing | 27/1 |

* cited by examiner

*Primary Examiner* — William Miller

(74) *Attorney, Agent, or Firm* — Norton Rose Fulbright US LLP

(57) ABSTRACT

An urn vault includes a base and a top portion which has one or more side walls, wherein the side walls protrude downward. Each opposing side wall is bonded length-wise to each adjoining side or to itself, creating a seamless cast top portion open at the bottom that lowers onto the base. Attached to the base are guide rails, bonded equidistant from the outside base edge on all sides of the base. This "rail system" is the fastening guide for the top portion which lowers onto the base, wherein the inside of the side walls interact with the outside edges of the four guide rails. In certain embodiments, the urn vault may be comprised of one or a combination of polymers. A system and method are further included.

18 Claims, 10 Drawing Sheets

URN VAULT

CROSS-REFERENCE TO RELATED APPLICATIONS

This application claims priority to U.S. Non-Provisional patent application Ser. No. 13/815,507, filed Mar. 7, 2013, which is hereby incorporated by reference in its entirety.

FIELD OF THE INVENTION

The present invention relates to the field of cremation urn burial vaults for protecting burial urns containing cremated remains.

BACKGROUND OF THE INVENTION

Cremation urn burial vaults ("vaults") are utilized to hold burial urns containing cremated remains, such as cremated human remains. Vaults currently available to consumers and made of concrete, steel, granite, marble, ceramic, stained glass, steel, or wood are unnecessarily heavy. According to subject matter disclosed herein, a cremation urn vault is of lower weight than vaults of comparable size and capacity. Having lower weight relative to their size and capacity, vaults according to the disclosed subject matter can be handled, transported and installed in a manner requiring less complexity, fewer personnel, less and lighter capacity handling equipment, and at less expense than required for existing, heavier vaults of comparable size and capacity. The disclosed subject matter provides lighter, more easily-handled cremation urn vaults. Disclosed subject matter provides vaults that are impervious to nature's elements to a greater degree than the above-mentioned urn vaults of existing design. The disclosed subject matter provides vaults having stronger structure than existing vaults and capable of withstanding the heavy weight of covering soil and heavy equipment that can pass across the covering soil. Disclosed subject matter provides a protective and sealable urn vault with far greater stability and durability than existing designs. The disclosed subject matter also provides vaults suitable for efficient, streamlined installation into a burial position in the ground. Embodiments also provide such vaults suitable for family members to safely lower the vault into a burial position by themselves, allowing additional opportunity for closure for grieving family and mourners. Disclosed subject matter also provides a vault that can be buried with reduced complexity and reduced installation costs. Disclosed subject matter provides a vault having a structural design and qualities of permanent durability that are suitable for selection for permanent burial of cremated remains by surviving family with confidence and peace of mind.

Disclosed subject matter also provides vaults of size, capacity and reduced weight suitable for purchase by consumers in advance of death ("pre-need") from suppliers such as funeral homes and funeral directors, and which can be easily handled, readily taken into immediate possession by consumers, and stored by consumers for later use at the time of death of a family member. Disclosed subject matter also provides such vaults that are suitable for customization of features desired by consumers and such as, for example, appearance features, in advance of death. Disclosed subject matter also provides such vaults that are suitable for easy handling, display, sale and delivery by suppliers such as funeral homes and funeral directors to consumers. Disclosed subject matter provides vaults that can be readily handled, displayed, sold and delivered in advance of death, on a pre-need basis, by suppliers such as funeral homes and funeral directors without requiring special handling equipment and heavy delivery trucks for transporting the vault to a location specified by the consumer. Disclosed subject matter provides such vaults having a design suitable for large scale, substantially automated manufacture in a relatively short manufacturing period, and with relatively low costs for manufacturing, transportation and storage. Disclosed subject matter provides an attractive, secure, and stable sealing urn vault that does not suffer from burial position stability problems, sealing problems, structural disintegration and weakening or breakage, and installation problems suffered with existing vaults.

Many cremation urn vaults are designed with a base adhered to sidewalls and a lid that closes from the top. Essentially, many cremation urn vaults are simply heavy boxes. These existing vaults are generally intended to seal and protect the urn contained therein from contaminants and the soil environment, but can fail for various reasons. Factors contributing to the failure of vaults of existing design include problems associated with the detrimental heavy weight of existing vaults, inferior construction materials, utilization of construction materials having improper material properties for the application and design dimensions, failure to incorporate adequate dimensional tolerances in the design considering the materials of construction, selection of material that are subject to failure or breaking down when permanently exposed to soil conditions, and problems caused by the difficulty of handling and burying heavy vaults formed of such materials.

The disclosed subject matter provides a polymeric urn vault of sound structural design and capable of being handled easily for burial. Disclosed subject matter provides a vault that is decorative and can serve as a display for an urn in a home setting (not buried). Disclosed subject matter provides a vault that seals tightly when underground, eliminating the threat of water, air, insects, and molds entering the urn having cremated remains contained therein. Disclosed subject matter provides a vault that in a buried position is capable of withstanding the weight of soil and heavy equipment atop the soil. Disclosed subject matter provides a vault that is sealed in a proven manner. In embodiments, a vault is sealed in the manner of an inverted empty glass, which is sealed when turned upside down in a sink full of water such that trapped air inside the glass presses against and prevents entry of the surrounding water.

Many vaults of existing design are very heavy and require either heavy machinery and/or extensive man-power for handling. This weight problem creates additional labor and increased costs. Concrete urn vaults, the most prominent on the market today, can weigh well over 100 lbs. and those skilled in the art recognize that these are extremely difficult to lower into burial spaces. Also, most concrete vaults are installed with an additional inner polymer liner to protect the urn because over time, water and moisture will weaken the integrity of the aggregate concrete, leading to cracks and eventual failure. Once failure occurs, the plastic liners collapse, leaving the cremation urn and its contents vulnerable to underground elements. For the size required, granite and marble urn vaults are usually cost prohibitive and their weight is similar, if not greater than concrete. Ceramic and glass are too fragile to entrust with protecting a family's "buried" urn. Wood is a bio-degradable substance that deteriorates quickly when buried, much like water-based, aggregate concrete. Also, if a family were to request a disinterment to remove a buried urn or add an additional urn, a concrete urn vaults would be extremely difficult to remove and if in fact the vault is still intact at the time of removal, the concrete lid would have to be broken in order to remove the urn. The concrete lid pieces falling into the vault could also damage the urn. Steel urn vaults do not seal, leaving the enclosed urn vulnerable to insects, molds and more, and even galvanized steel will succumb to rust in a moist environment. According to the disclosed subject matter is provided an extremely strong, durable, and easily handled urn vault capable of being reopened and resealed if requested, and which can be easily manufactured and quickly assembled with relative ease and reduced cost for handling and transport. In accordance with the present disclosure, there is provided a sealable polymeric urn vault that is both functional and decorative. Embodiments provide a cremation urn vault that comprises four polymeric side walls which are bonded together to provide a completely sealed square or rectangular environment devoid of any penetration by water, moisture, air, mold, or insects. In embodiments, the urn vault includes a generally square piece of polymer serving as the base and a generally square polymeric top panel which will have the four adjacent side walls cemented to its edges with all four protruding downward. Each opposing side wall is bonded length-wise to each adjoining side, creating a seamless polymeric box that is open at the bottom and lowers onto the base. All polymeric pieces are bonded using a special solvent adhesive that molds adjoining pieces into a single entity by first softening the polymeric surfaces to be joined and subsequently fusing them together when the solvent dissipates. This leaves a strong, glue-free joint. This is referred to as "solvent welding" or "adhesive bonding". Both terms will be used throughout this disclosure. Because the solvent adhesive used is formulated for adhering polymeric sheets together, the resulting pieces have the tensile strength of a single, solid sheet of polymer. In embodiments, attached to the base are guide rails which are bonded equidistant from the outside edge of all four sides of the vault. This "square railing system" serves as the resting guide for the seamless polymeric box which then lowers onto the base with the four side walls resting against the outside of the four rails. The fit is such that the top walls are held securely in place by the guide rails with no opportunity to slide or move in its position on the base. In embodiments, underneath the base are four square cubes that are set near each corner. The four cubes serve as pedestal feet which enable the device to be moved by being lifted from beneath the base. Also, the underneath space created by the pedestal feet may allow the use of straps or ropes if the urn vault is to be lowered into the ground, such as from any distance that makes it difficult to lower the vault by hand. In embodiments, the urn vault can be made of panels having different wall thickness such as, for example, greater wall thickness, as desired to provide support and extra protection from unusually heavy equipment or extremely harsh environments. According to embodiments, a polymeric urn vault can be altered to meet any urn size requirement. In embodiments, the urn size can be altered by increasing the height or length, or both, of the sidewalls, and the base unit dimensions can be adjusted accordingly. It will be understood that the scope of disclosed subject matter is not limited to the particular structures, dimensions or configurations set forth herein.

According to disclosed subject matter, a polymeric urn vault serves to protect the integrity of a cremation urn enclosed therein for a substantially longer period of time than concrete urn vaults when buried in soil. According to disclosed subject matter, a polymeric urn vault is impervious to the elements that target the two inherent weaknesses of concrete. Unlike concrete, disclosed subject matter comprises a vault formed of polymeric material that, in one aspect, may be selected for possessing the properties of being substantially unaffected by moisture; being resistant to degradation upon prolonged exposure to chemicals present in soil environments; substantially resistant to impact; and possess necessary structural strength. Vaults constructed of existing materials such as concrete, steel, marble, granite or bronze require extra labor and machinery to move them into place. Disclosed subject matter provides a polymeric urn vault that is very light weight and suitable for use as a decorative presentation device in the homes of families that delay urn burial. In a home, the vault can both separate and protect the cremation urn in a decorative environment until a time is selected for burial. The vault and urn can be moved to the burial location. Once the vault is lowered into the burial position with the urn inside, a solvent adhesive is administered along the outside of the vault base guide rails to permanently bond adjoining parts of the vault, and thus sealing the urn inside for all time. In an embodiment, at the time of interment the base and top can also be placed in position without the bonding compound, leaving the vault in a position to be opened at any point in the future should the family wish to do so. Even without the use of the sealing adhesive, the weight of the topsoil and grass may hold the top of the vault in place with the trapped air pressure sealing the urn inside, free of the threat of water, insects, mold, and the weight of heavy equipment.

Disclosed subject matter provides a sealing urn vault that protects the cremation urn in an isolated, underground environment created by trapped air pressure which prevents any water, moisture, or underground contaminants from entering the urn vault.

Disclosed subject matter provides a cremation urn vault that offers a sealed environment even if the urn vault is not permanently sealed by solvent adhesive. Once the top is placed onto the base and is held in place by the base guide rails, the trapped air pressure inside the vault provides a sealed environment in order to repel water, chemicals, and insects as when sealed permanently.

Disclosed subject matter provides a sealing cremation vault that when no solvent adhesive is required, the vault may be reopened simply by removing the fill dirt and lifting the vault top off of the base at any time in the future. This is required if a family requests a disinterment or if they wish to place a second urn inside the vault which can then be permanently sealed once the final urn is in place. No other existing cremation urn vault serves this purpose.

Presently, cremation ashes are placed into various types of cremation urns, including wood, bronze, marble, ceramic, and even plastic containers. A large percentage of these families are choosing to bury the cremation remains in cemeteries, private sites, and garden settings. If the cemetery or cremation garden requires an outer burial container for cremation ashes or if the consumer wants additional protection for the buried urn, the urn vault of the current disclosure serves that purpose. If an urn vault is not required, but the family requests the vault just to guarantee the integrity of the urn itself, this urn vault serves that purpose. If a grieving family wishes to take part in the burial ceremony to achieve closure, they may place this cremation urn vault into the designated grave space themselves. Subject matter of the disclosure serves that purpose as well, and this is an act not allowed by current urn vaults. Where families wish to delay the act of interring the cremation urn, disclosed subject matter serves the purpose of providing a protective and decorative display device for the urn both before and after the burial.

BRIEF DESCRIPTION OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings, wherein:

For purposes of clarity and brevity, like elements and components will bear the same designations and numbering throughout the Figures.

DETAILED DESCRIPTION OF ILLUSTRATIVE EMBODIMENTS

Reference now should be made to the drawings, in which the same reference numbers are used throughout the different figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

The current disclosure will now be described more fully, referencing the accompanying drawing FIGS. 1-7 in which embodiments of the disclosure are shown. The disclosure may also be embodied in several different forms and should not be considered limited only to the embodiment set forth here. Those skilled in the art will recognize the accompanying embodiments as illustrative in nature and should not be seen as limiting in any way. The embodiments of the current disclosure will fully disclose the scope of the invention to those that are skilled in the art.

Figure 1:
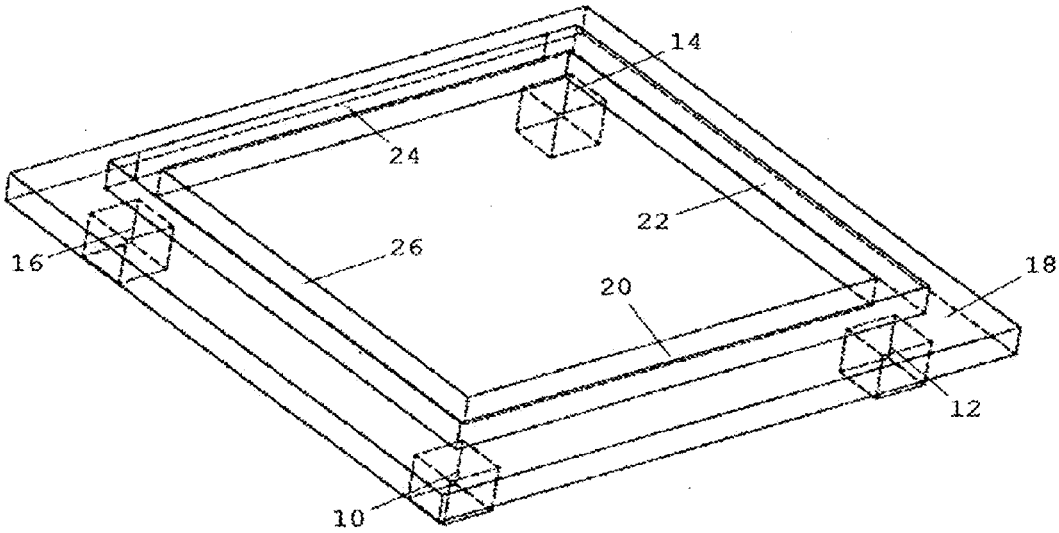
FIG. 1 is a bottom perspective view of an urn vault base with the sealing guide rails attached, according to embodiments.

FIG. 1 illustrates a bottom perspective view of an urn vault base 18 in accordance with embodiments of the current disclosure. As shown in FIG. 1, according to disclosed subject matter, in embodiments urn vault 44 includes a square base 18 and a corresponding square top portion 42 that is open at the bottom and in cooperation with the base 18 will seal air and water tight with the square base 18. One of ordinary skill will understand that urn vault 44 need not be square or a cube, and can have any desired shape that is suitable for containing and having sealed therein a cremation urn. Both the top portion 42 and the base 18 as depicted in FIG. 1 are made of cell cast polymeric material. All pieces of the urn vault are bonded using a solvent adhesive which molds adjoining pieces into a single entity by first softening the polymeric surfaces to be joined and then fusing them together when the solvent dissipates, leaving a strong glue-free joint. This is referred to as "solvent welding". Cast polymers are very light, with a number of polymers weighing less than its glass counterpart and much less than any current competitor's concrete or steel urn burial vaults. Cast polymer makes the current disclosure extremely light, portable, and more attractive as a preneed sales item to funeral homes and families in need than any current known solution. Purchasers may easily carry a polymeric urn vault home to be used as an attractive, ornamental display case until it is time for the cremation urn to be sealed in the polymeric urn vault 44 (FIG. 3) and buried underground. In a preferred embodiment, the thicknesses of the top portion and base may be ⅝".

Referring to FIG. 1, the urn vault base 18 is depicted as a square and is supported underneath by four cubed, pedestal feet 10, 12, 14, and 16, inset from each corner. Supporting the base 18 in the front are the first pedestal foot 10 and second pedestal foot 12. Supporting the base 18 underneath at the rear are the third pedestal foot 16 and fourth pedestal foot 14. All four pedestal feet are duplicated in size and shape. The positioning of the four pedestal feet allow the polymeric urn vault base 18 to sit just above the soil when buried. The pedestal feet 10, 12, 14, and 16 are attached to the base 18 using an adhesive solvent. Also, the cubed feet allow the urn vault 44 to be easily lifted, placed, and moved about on a shelf or table when it serves as a presentation device prior to interment. The space created by the block feet would allow the use of straps or ropes if the urn vault is to be lowered into the ground any distance that might make it difficult to be lowered by hand. The current disclosure is unlike the current urn vaults which are either too heavy, too cumbersome, or too bulky and most aren't intended for the consumer to view much less handle themselves. This polymeric urn vault 44 provides for this need. In a preferred embodiment, the dimensions of the urn vault base may be 12"×12" and the dimensions of the cubed pedestal feet may be 1"×1"×1". In a further embodiment, the cubed pedestal feet may be inset 1" from each corner of the urn vault base. In an alternative embodiment, the pedestal feet may be screwed into holes found on the bottom of the base 18. The screws may be embedded within the pedestal feet 10, 12, 14, and 16.

FIG. 1 further illustrates the guide rail sealing system. The four depicted guide rails measuring 9.75"×0.625"×0.625" are solvently welded to the base 18. The base 18 is comprised of first guide rail 20, second guide rail 22, third guide rail 24, and fourth guide rail 26. These rails provide the fastening system for the top portion 42 where the opposing side panels 32 and 36 as well as the end panels 30 and 34 fit snugly against the outer edges of the guide rails where they will be solvently welded to the rails, sealing the urn vault air and water tight. In other embodiments, the dimensions of the guide rails may vary in length, width, and/or height from the above mentioned guide rail embodiments.

Figure 2:
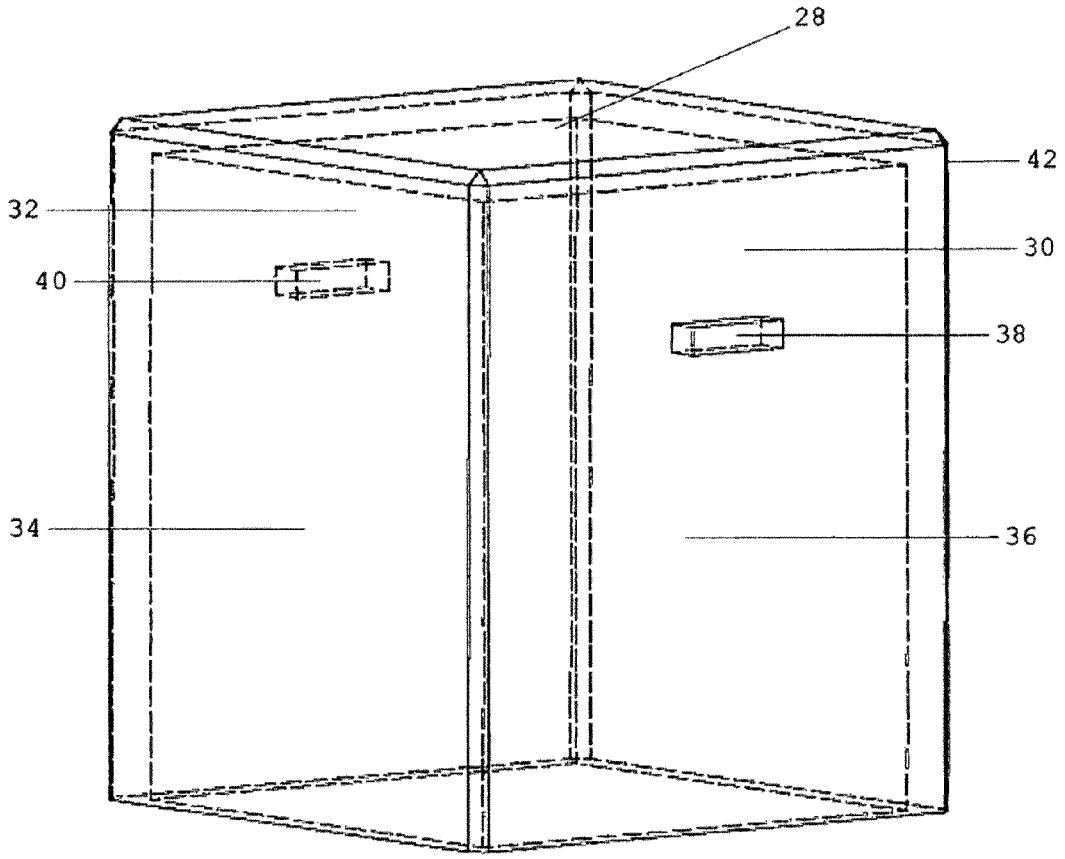
FIG. 2 is a top section view of an urn vault and its five-sided top rectangular section, according to embodiments.

FIG. 2 illustrates a view of the top portion 42 in accordance with embodiments of the current disclosure. The top portion 42 is comprised of a generally square top panel 28, a first panel 30, a second panel 34, a third panel 32, and a fourth panel 36. In embodiments, each opposing panel is made of cast polymer and all are solvently welded to their adjacent panels and to the top panel 28. An adhesive solvent distributed at each connecting joint molds the five polymeric pieces into a strong, single weight-bearing entity. Specifically, all five bonded polymeric pieces form a single entity that is open at the bottom and serves as the top enclosure 42. Also illustrated in FIG. 2 are the opposing top handles, a first handle 38 and a second handle 40. Each handle may be centered in the middle side of each opposing side panel 32 and 36 or may be placed on another area of the side panels 32 and 36 in certain embodiments. The side handles 38 and 40 enable the urn vault 44 (FIG. 3) to be lifted and lowered with ease. In embodiments, the handles 38 and 40 may be made of polymer. When the handles 38 and 40 are made of polymer, the handles 38 and 40 may be attached to the side panels 32 and 36 using a solvent adhesive. It is noted that the top side handles 38 and 40 can be easily moved. Because of the light weight of the urn vault when constructed of polymer, no outside agencies are necessary to contract in order to install the urn vault 44 and savings can be passed to the consumer. Current urn burial vault solutions do not meet the needs of the industry because they are much heavier, much more difficult to handle, and require additional machinery/manpower to install, resulting in additional expenses for the consumer. In a preferred embodiment, the handles 38 and 40 may have dimensions of 2"×5"×0.375". In another preferred embodiment, the handles 38 and 40 may be placed 3" below the top panel 28.

Figure 3:
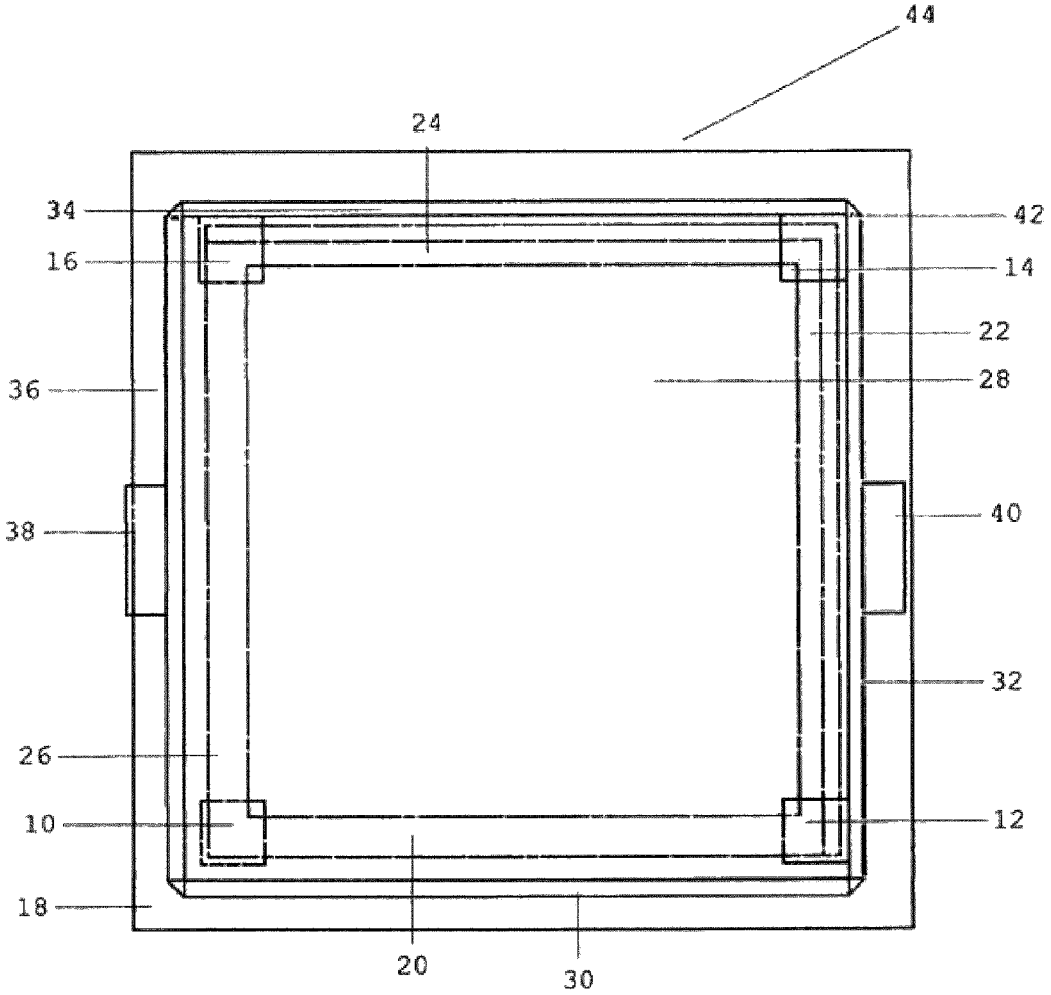
FIG. 3 is a top perspective view of an urn vault base with the sealing guide rails attached, according to embodiments.

Referring now to FIG. 3, FIG. 3 displays a top perspective view of an embodiment of an urn vault 44 and includes a view of the top portion 42 resting in its sealing position on the square base 18 and gripping the outer sides of the base guide rails 20, 22, 24, and 26. The guide rails 20, 22, 24, and 26 may comprise interior, top, and exterior sides when the guide rails are placed on the top side of the base 18. The interior sides of the four downward-extending side panels 30, 32, 34, and 36 rest tightly against the exterior sides of the rails 20, 22, 24, and 26. This positioning stabilizes the top portion of the urn vault 44 and keeps it from becoming displaced in any way once interred. Once the urn vault 44 is ready to be interred, the top portion 42 may be solvently welded to the base 18 at the guide rails 20, 22, 24, 26. This will permanently seal the vault 44 air and water tight. The perspective is looking downward on the top portion 42 and looking through the generally square top panel 28 to the base 18. Also evident are the four stabilizing pedestal feet 10, 12, 14, 16.

FIG. 3 further illustrates the two side handles 38 and 40 as well as the first, second, third, and fourth side panels 30, 32, 34, and 36. When weight or backfill dirt is placed on the top portion 42 of the urn vault 44, the sealing nature of the polymeric urn vault 44 distributes the weight from the top to the base 18 and through the pedestal feet 10, 12, 14, and 16. FIG. 3 also shows the overlap of the base 18 which allows for much easier handling of the urn vault 44. Once the vault top 42 has been fastened to the base 18, any weight, such as backfilling soil that is placed on top and/or around this urn vault 44 is transferred to the base 18 at the guide rails 20, 22, 24, and 26 and is then moved to the outside base edges where it is dispersed. In a preferred embodiment, the overlap of the base is ½".

Figure 4:
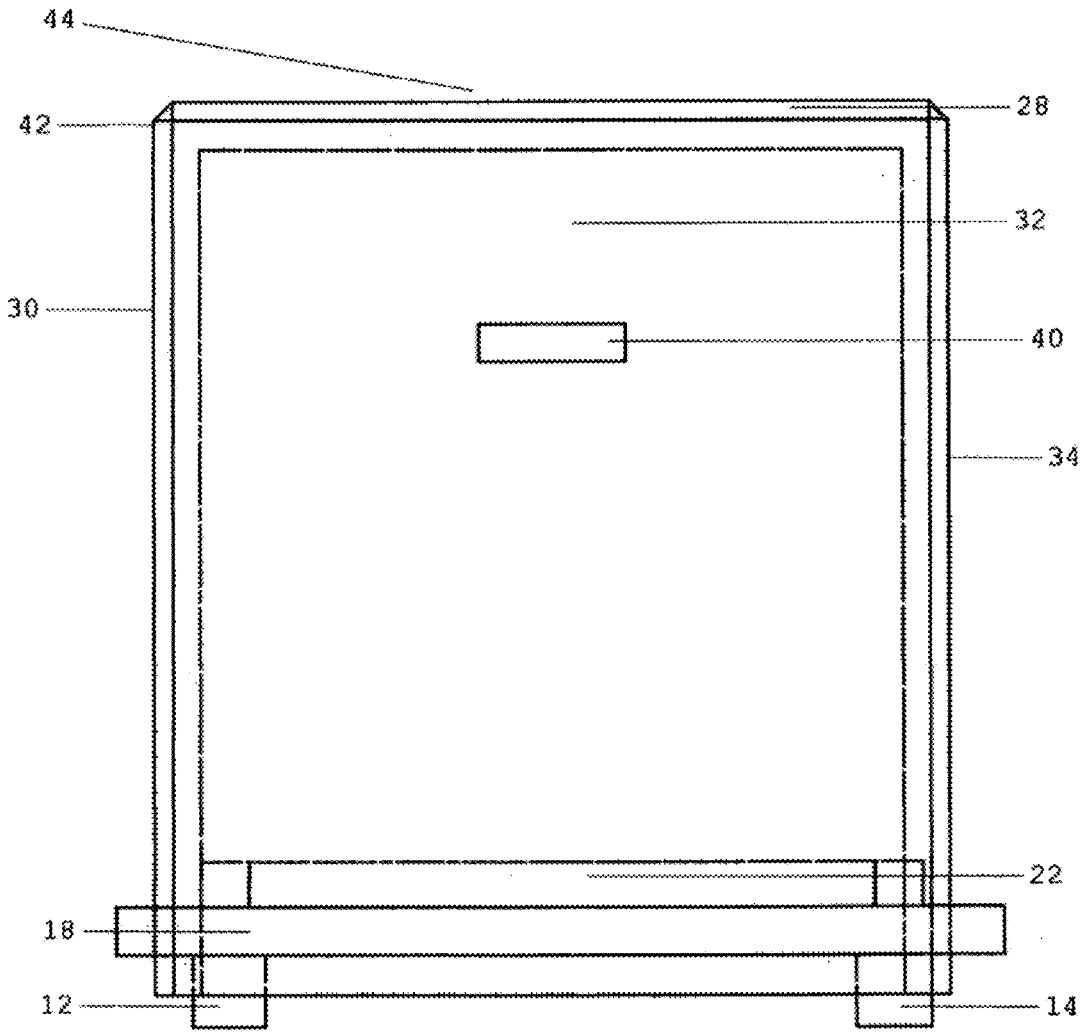
FIG. 4 is a left perspective view of an urn vault top section in its sealed position on the base, according to embodiments.

Further illustrated in FIG. 4 is an embodiment of the urn vault 44 viewed from a side perspective. More specifically, the embodiment of the urn vault 44 displays a second side panel 32 solvently welded to a top panel 28 and adjoining first and third end panels 30 and 34. Solvently welded to the second side panel 32 is the second side handle 40. Also evident is the square base 18 and two attached second and third pedestal feet 12 and 14. According to the preferred embodiment displayed in FIG. 4, the top portion 42 is in its sealing position with the inside of the second side panel 32 resting firmly against the outside edge of the attached second guide rail 22. The solvent welds the inside of the second side panel 32 with the outside wall of the second guide rail 22. These two entities fuse together to form one single solid piece and the process is repeated with the fourth side panel 36 and third guide rail 26, as well as with the first and third side panels 30 and 34 and the first and third guide rails 20 and 24. This sealing position stabilizes the top portion 42 of the urn vault 44 and does not allow it to be moved or displaced in any way once it is buried. This in turn makes disengagement or a breach of the sealing system impossible.

The disclosed polymeric urn vault embodiment also surpasses the benefits of any present urn burial vaults in that the polymeric urn vault top portion 42 may be placed onto the base 18 without being solvently welded to the base guide rails 20, 22, 24, and 26 and trapped air inside the top portion 42 may seal the polymeric urn vault 44 air-tight and water-tight, providing a completely sealed environment devoid of any penetration by water, moisture, air, or insects. The additional benefit here is that the polymeric urn vault 44, after ground burial, may then be uncovered at some point in the future and reopened in order to add an additional urn. The weight of the overhead fill soil keeps the top portion 42 in place and guarantees the enclosed urn will remain protected and free of any underground contaminants. Once a second urn is added, the polymeric urn vault top 42 may be solvently welded to the polymeric base 18 and its accompanying guide rails 20, 22, 24, and 26. By using the polymeric urn vault, consumers may avoid additional expenses by not having to purchase duplicate urn burial vaults.

Figure 5:
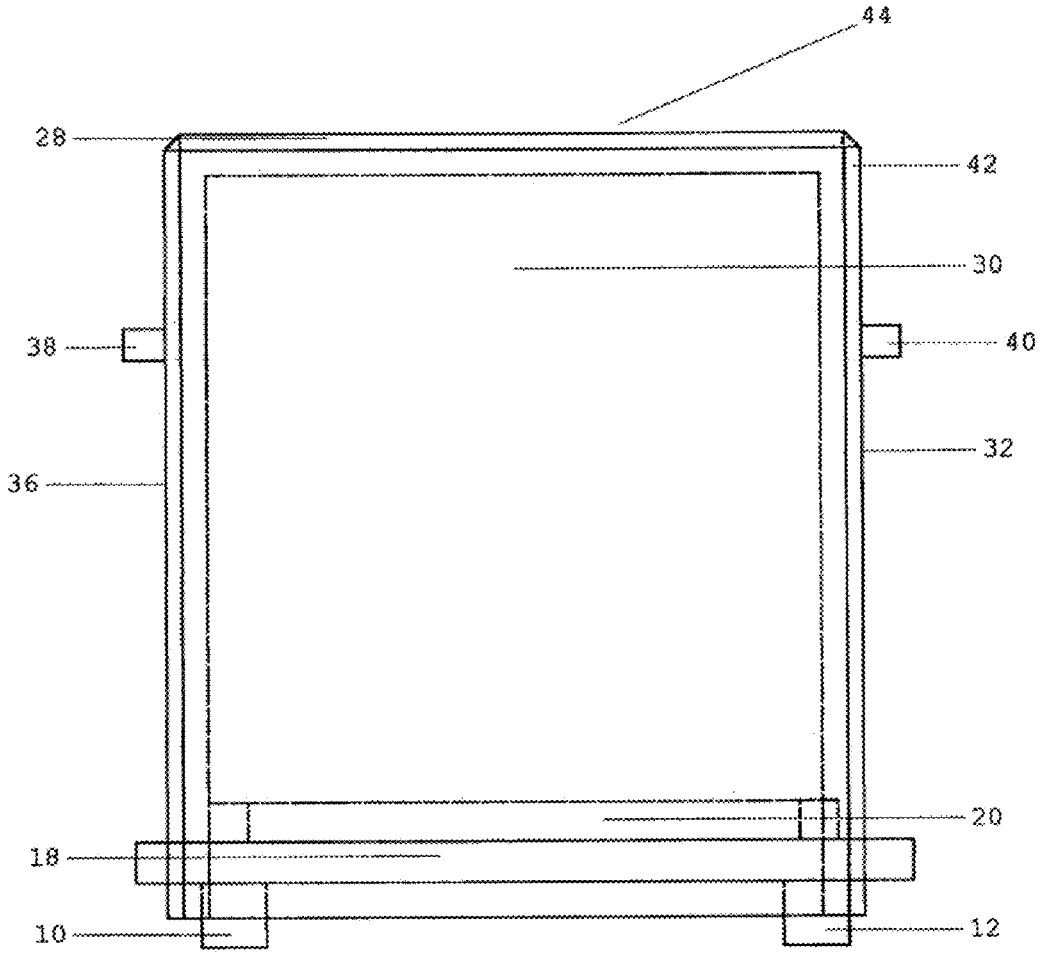
FIG. 5 is a front perspective view of an urn vault top section in its sealed position on the base, according to embodiments.

Referring now additionally to FIG. 5, FIG. 5 illustrates a front perspective of an embodiment of an urn vault 44 set forth herein. As in FIG. 4, FIG. 5 shows the urn vault 44 with the top portion 42 in its seated position on the base 18. The inside wall of the first side panel 30 is positioned directly against the outer edge of the first guide rail 20 and is solvently welded to that edge just as it is solvently welded to the adjoining second and fourth side panels 32 and 36 as well as to the top panel 28. The location of the second side handle 40 and the first side handle 38 is noted, which again, are solvently welded to their respective polymeric side panels. Best illustrated in the current embodiment are the first and second base pedestal feet 10 and 12 which aid in the handling of the urn vault 44. More specifically, FIG. 3 displays the unique sealing characteristic embodied by the current disclosure, separating it from all of the current urn vaults available to consumers today.

Figure 6:
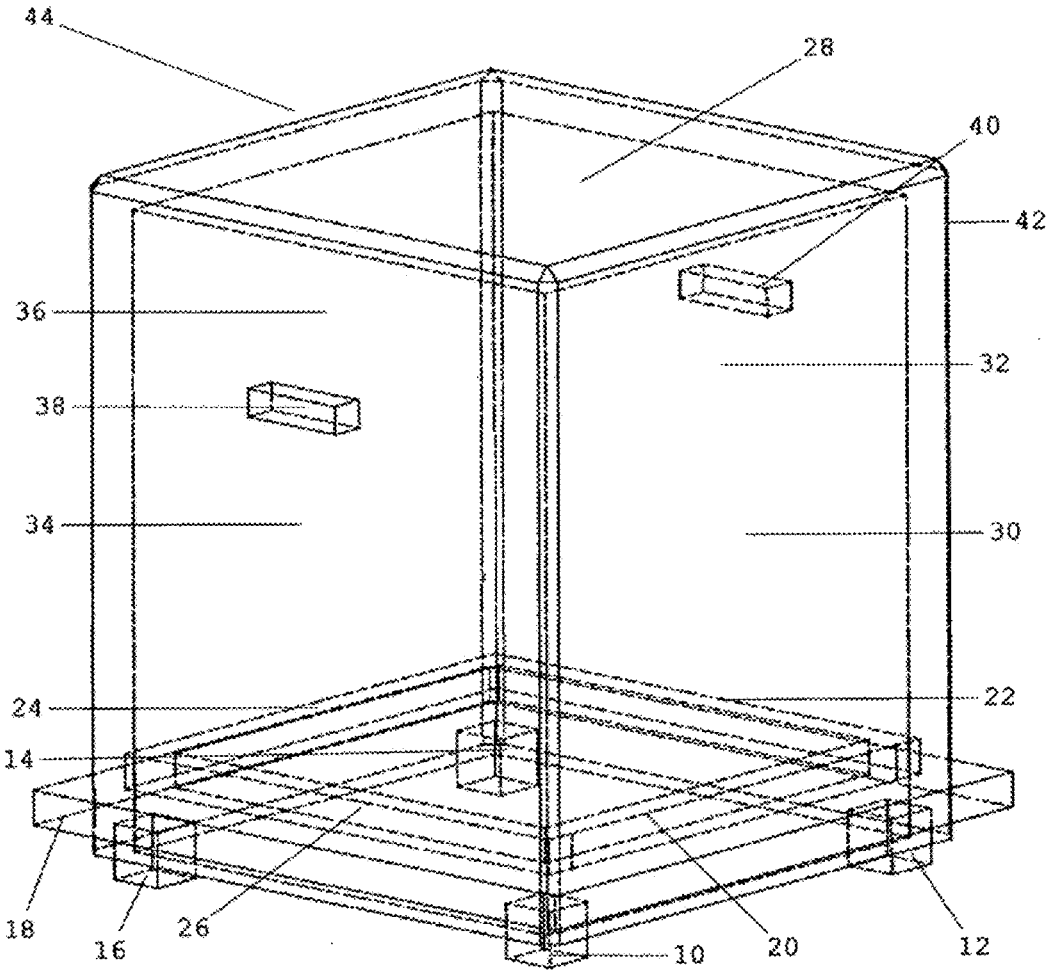
FIG. 6 is a right sectional view of an urn vault top section in its sealed position on the base, according to embodiments.
Figure 7:
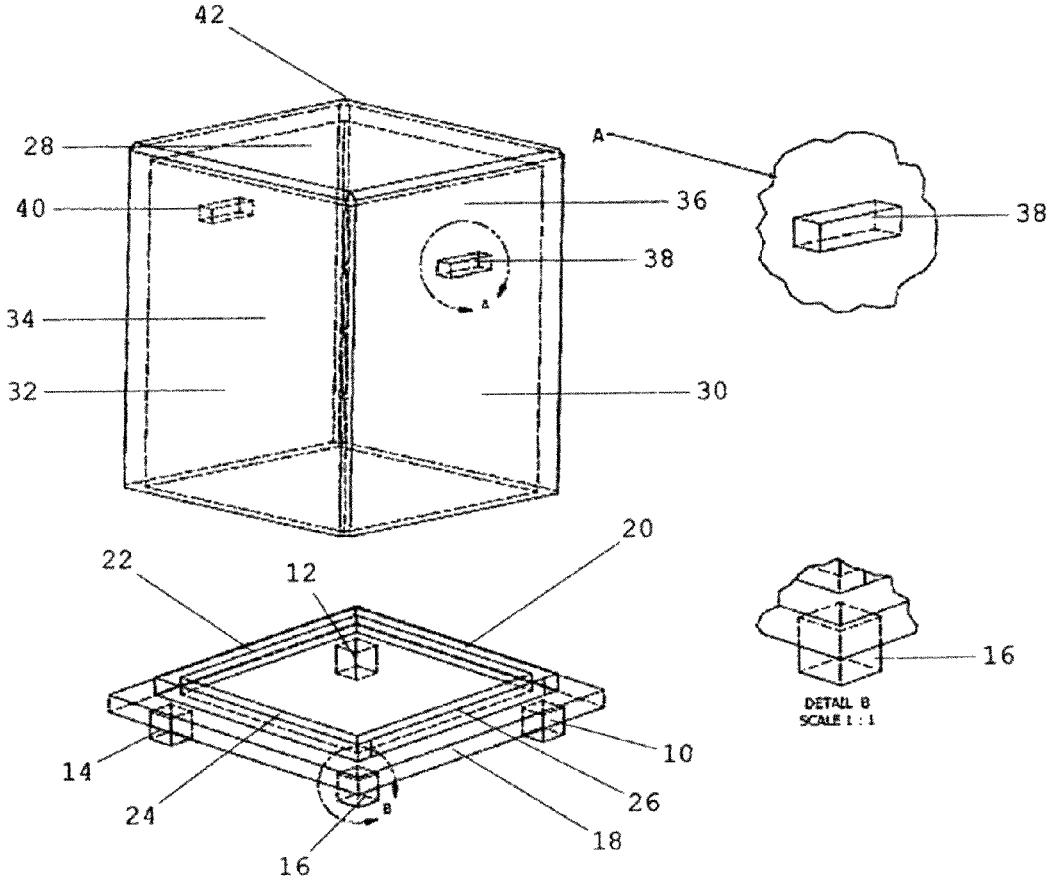
FIG. 7 is a front exploded view of an urn vault with the top section separated from the base, according to embodiments.

As further illustrated in FIGS. 6-7, the generally square base 18 may include four cubed pedestal feet 10, 12, 14, and 16. The feet are located just inside each corner of the base 18, enabling the base 18 to be more easily maneuvered by funeral professionals and consumers alike. Further, as best illustrated in FIG. 7, the base 18 supports the guide rail sealing system including guide rails 20, 22, 24, and 26 solvently welded to one another and the base. In a preferred embodiment, the guide rails 20, 22, 24, and 26 are placed 1" from the edges of the base 18. Specifically, FIG. 6 details a right perspective of an embodiment of an urn vault 44, illustrating the urn vault top portion 42 securely positioned on the base 18 with generally square top panel 28 solvently welded to all four downward-extending side panels 30, 32, 34, and 36. With the top panel 28 and all four side panels 30, 32, 34, and 36 solvently welded to each adjoining panel, the top portion 42 becomes a single structural entity and further optimizes the incredible strength of the structure of the urn vault. Once the rectangular top portion 42 is solvently welded to the base guide rails 20, 22, 24, and 26, the first side handle 38 and second side handle 40 allow the urn vault to be easily lifted and moved into position for burial or relocated to a display position.

Referring additionally to FIG. 7, an embodiment of the urn vault 44 details a right perspective of the rectangular top section 42 prior to its fastening to the polymeric base unit 18. Again, the top panel 28 has been solvently welded to its downward-extending first 30, second 32, third 34, and fourth 36 side panels with the first handle 38 and second handle 40 evident in their respective locations. Attention may be drawn to the presence of the base 18 and its guide rail fastening system with first guide rail 20, second guide rail 22, third guide rail 24, and fourth guide rail 26. All are solvently welded to each other at the ends of the guide rails and to the base 18 underneath each rail. Raising the base 18 for easier mobility are the base pedestal feet, including the first pedestal foot 10, second pedestal foot 12, third pedestal foot 14, and fourth pedestal foot 16.

In a preferred embodiment, all panels of the urn vault may be constructed of ⅝" inch thick acrylic. This urn vault, at ⅝" thickness, has a minimum tensile strength of 1500 psi, two times more than any current concrete urn vault. One vital purpose of this acrylic urn vault is that at only 12 lbs., it is very easily moved and can be handled by most any consumer, unlike the average concrete urn vault which weighs in at well over 100 lbs.

In a further embodiment, the urn vault may be constructed of acrylic. In this case, preferred adhesives include, but are not limited to IPS Weld-On 3 and IPS Weld-On 4. These acrylic adhesives were chosen to be used on the smooth finished edges of said acrylic urn vault 44 so that the joints are clear of any residue once it dries. Other fastening systems are available for acrylic, including cyano-acrylate (super glue), methylene chloride, epoxy, and other acrylic adhesives.

The current disclosure has been described in considerable detail and those skilled in the art will recognize that modifications in the shape, size, materials, and arrangement of parts may be made. Other sizes and shapes of polymeric urn vault components may be selected to accommodate various cremation urn dimensions. For example, the urn vault may have its sides lengthened to any height for a taller urn or the base 18 may be stretched to accommodate longer cremation box-type urns. The urn vault may be altered by adding or subtracting side panels and may take the shape of a triangle, pentagon, hexagon, or any suitable shape. In another embodiment, the urn vault may be altered by constructing the base 18 as a circular or oval shape. The base panel, top panel, side panels, and guide rails may also be altered accordingly to match the shape created by the side panels. For example, in order to match a circular base, a side panel may be created that is cylindrical in shape. The top panel may be circular in order to match the circular base. A single guide rail may be created that is shaped like a circle. The pedestal feet may or may not mimic the shapes of the rest of the elements of the polymeric urn vault. As a further example, if the base is pentagonal in shape, the side panels may be shaped like a pentagonal prism, the top panel may be pentagonal in shape, the guide rails may be pentagonal in shape, and the pedestal feet may or may not mimic a pentagonal shape.

Materials may vary among embodiments. In certain embodiments, the polymeric urn vault may be comprised of one or a combination of polymers such as, but not limited to polyamideimide, polyethersulphone, polyetherimide, polyarylate, polysulphone, amorphous polyamide, polymethylmethacrylate, polyvinylchloride, acrylonitrile butadiene styrene, polystyrene, polyetheretherketone, polytetrafluoroethylene, polyamide 6,6, polyamide 11, polyphenylene sulphide, polyethylene terephthalate, polyoxymethylene, polypropylene, high density polyethylene, low density polyethylene, and/or any other transparent or translucent polymer. According to an embodiment, for example, suitable polymeric material comprises polyethylene terephthalate.

Solvents may also vary among embodiments. In certain embodiments, parts of the polymeric urn vault may be solvently welded using one or more solvents such as, but not limited to acetaldehyde, acetic anhydride, acetone, hydrofluoric acid, trifluoroacetic acid, acetic acid, hydrochloric acid, nitric acid, sulfuric acid, ethyl alcohol, isobutyl alcohol, methyl alcohol, n-butyl alcohol, propyl alcohol, ammonium hydroxide, aniline, aqua regia, benzaldehyde, benzene, carbon tetrachloride, caustic soda, chlorobenzene, chloroform, cyclohexane, esters, ether, diethyl ether, isopropyl ether, methyl ether, hexane, hydrazine, hydrogen peroxide, methylene chloride, petroleum ether, phenol, sodium hydroxide, tetrahydrofuran, toluene, trichloroethylene, trimethylpentane, xylene, and/or any other solvents that may solvently weld transparent or translucent polymers. According to an embodiment, for example, wherein polymeric material comprises polyethylene terephthalate, a suitable solvent can comprise phenol, such that a solvent weld is formed between adjoined solvent welded members, wherein the solvent weld comprises conjoined polymeric material.

Furthermore, an embodiment of the current disclosure may include polymeric ¾" thick walls to warrant extra protection from extraordinarily heavy equipment. This urn vault can also be manufactured to meet any urn size requirement. It should be understood that the current disclosure is not limited to the specific embodiments disclosed herein.

In a further embodiment, one or more of the parts that make up the polymeric urn vault (base panel, top panel, side panels, guide rails, pedestal feet, and handles) may be colored. The parts may be colored by applying a coating or by using a colored transparent or translucent polymer to create the parts.

Figure 8:
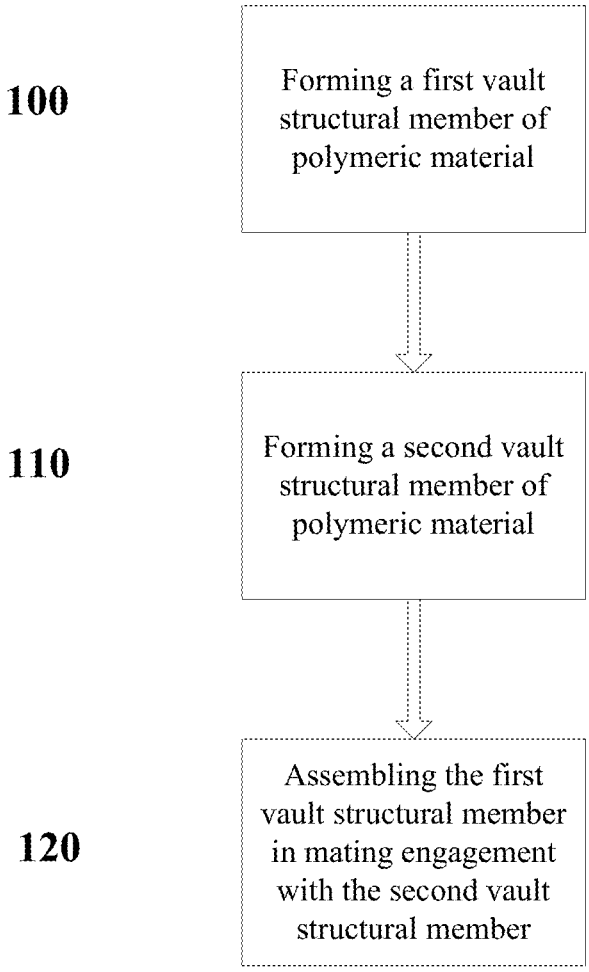
FIG. 8 displays an embodiment of a method used to create an urn vault.

FIG. 8 displays an embodiment of a method used to create an urn vault 44. The first step taken comprises forming a first vault structural member of polymeric material. The forming 100 includes forming the first vault structural member through solvently welding at least one side panel to another of the at least one side panel and solvently welding the at least one side panel to a top enclosure panel. In the case of a cylindrical (or similar embodiment) of the urn vault 44, the at least one side panel may be solvently welded to itself and to the top enclosure panel 28. The second vault structural member of polymeric material may be formed 110 by solvently welding at least one guide rail to the top side of a base panel and solvently welding at least one pedestal foot to the bottom side of the base panel. The first vault structural member may then be assembled 120 in mating engagement with the second vault structural member. The mating engagement may refer to an interior surface of the at least one side panel coming in contact with an exterior surface of the at least one guide rail. This may be executed by essentially placing the first vault structural member "on top of" the second vault structural member.

Figure 9:
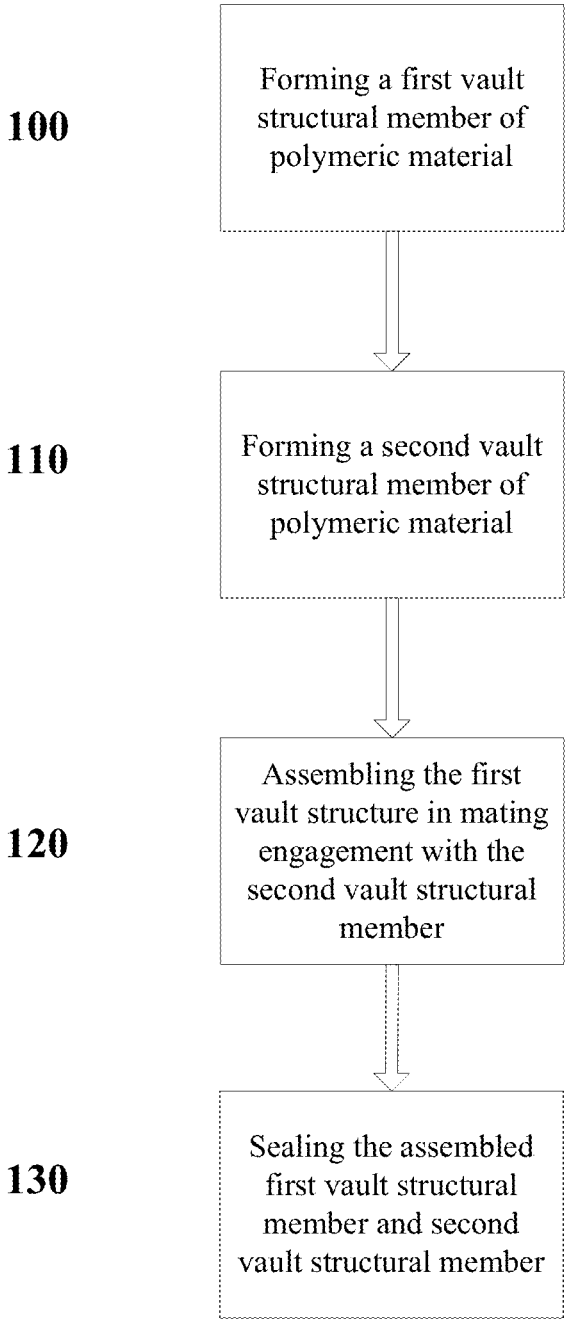
FIG. 9 displays a further embodiment of a method used to create an urn vault.

In a further embodiment found in FIG. 9, the method may further comprise the step of sealing 130 the assembled first vault structural member and second vault structural member using a solvent. The sealing 130 may be carried out by applying the solvent to the exterior side of the guide rails 20, 22, 24, and 26 and positioning the second vault structural member to where the interior surface of the side panels 30, 32, 34, and 36 are in direct contact with the applied solvent and the exterior side of the guide rails 20, 22, 24, and 26. The exterior side of the guide rails 20, 22, 24, and 26 and the interior surface of the side panels 30, 32, 34, and 36 may then become solvently welded to each other, therefore creating a sealed environment within the urn vault 44.

In further embodiments, the above methods may be applied to create urn vaults 44 of any suitable shape such as, but not limited to a triangle, a pentagon, and a hexagon.

Figure 10:
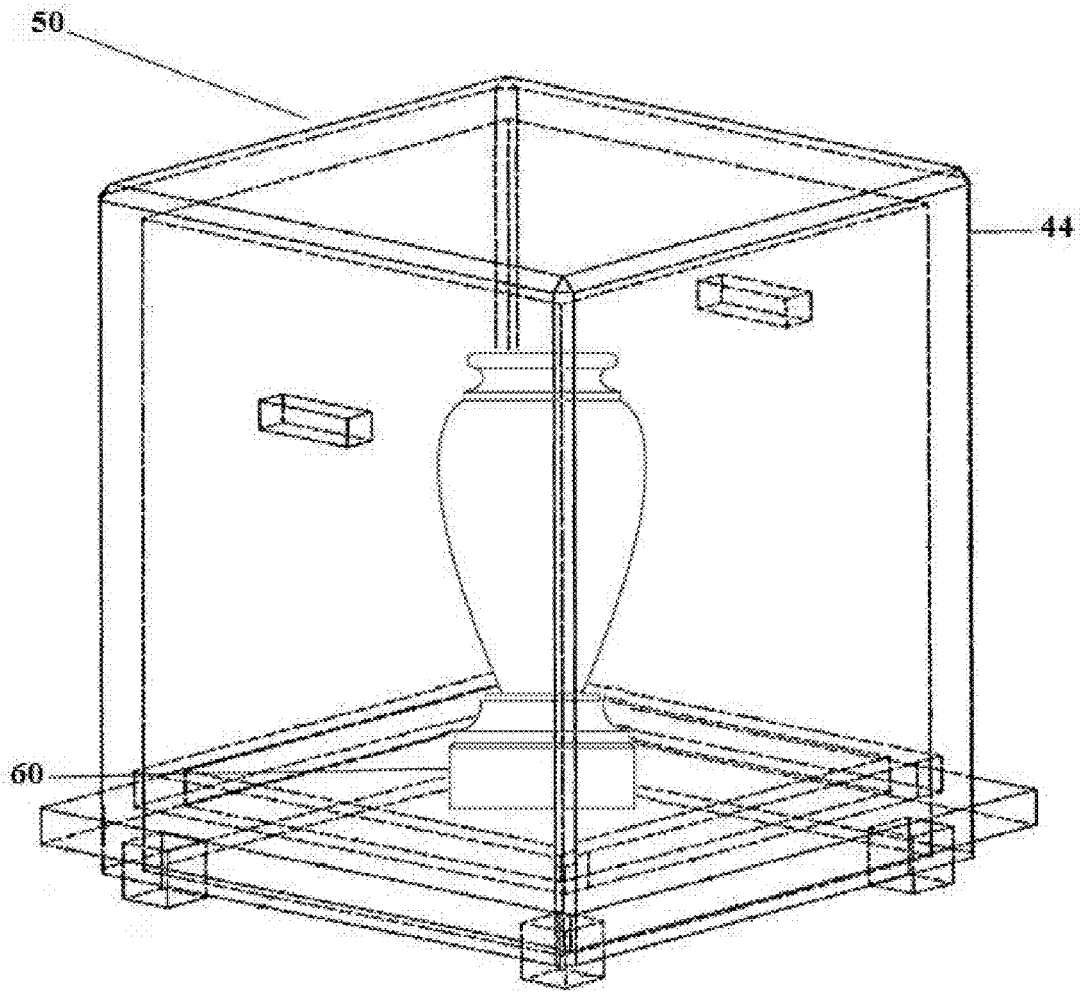
FIG. 10 depicts an embodiment of an urn vault system of the current disclosure.

FIG. 10 depicts an embodiment of an urn vault system 50 of the current disclosure. The embodiment of the urn vault system 50 may comprise parts or features found in any of the embodiments of the urn vault 44 found in this disclosure as well as an urn 60 that may be housed within the sealed environment found within the urn vault system 50.

In a preferred embodiment, parts of the urn vault system 50 may comprise specific measurements. The urn vault system 50 may comprise 9.75 inch×11.5 inch×0.625 inch acrylic first and third side panels 30 and 34, 10.75 inch×11.5 inch×0.625 inch acrylic second and fourth side panels 32 and 36, 2 inch×0.5 inch×0.375 inch acrylic side handles 38 and 40, a 10.75 inch×10.75 inch×0.625 inch acrylic top enclosure panel 28, 9 inch×0.625 inch×0.625 inch acrylic guide rails 20, 22, 24, and 26, and 1 inch×1 inch×1 inch pedestal feet 10, 12, 14, and 16.

In further embodiments, the above urn vault system 50 may take the shape of urn vaults 44 of aforementioned embodiments such as, but not limited to a triangle, a pentagon, and a hexagon.

In certain embodiments, the urn vault may not include handles.

In certain embodiments, the urn vault may not include pedestal feet.

In certain embodiments, the exterior sides of the guide rails 20, 22, 24, and 26 may be solvently welded to the interior sides of the side panels 30, 32, 34, and 36.

In certain embodiments, the bottom edges of the side panels 30, 32, 34, and 36 may be solvently welded to the top side of the base panel 18.

In certain embodiments, the exterior sides of the guide rails 20, 22, 24, and 26 may be solvently welded to the interior sides of the side panels 30, 32, 34, and 36 and the bottom edges of the side panels 30, 32, 34, and 36 may be solvently welded to the top side of the bottom panel 18.

For the purposes of this disclosure, the term "solvent adhesive" includes, but is not limited to, a solvent that breaks down the bonds of a polymer (softens the polymer) and allows two "softened" polymers to be joined and subsequently fused together.

For the purposes of this disclosure, the terms "solvent adhesive" and "solvent" are synonymous.

For the purposes of this disclosure, the terms "top panel" and "top enclosure panel" are synonymous.

For the purposes of this disclosure, the terms "top portion" and "first vault structural member" are synonymous.

Having thus described the current disclosure, what is desired to be protected by Letters Patent is presented in the subsequently appended claims.

What is claimed is:

1. An urn vault for containing a cremation urn, comprising:

at least one side panel, wherein each of the at least one side panels comprises an interior surface and an exterior surface, further wherein the at least one side panel forms an enclosure for receiving the cremation urn;

a top enclosure panel solvently welded to the at least one side panel;

a base panel comprising a top side and a bottom side, wherein the at least one side panel, top enclosure panel, and base panel are at least partially transparent; and at least one guide rail solvently welded to the top side of the base panel;

wherein the interior surface of the at least one side panel is configured for sealing mating engagement with the at least one guide rail.

2. The urn vault of claim 1, wherein one of the at least one side panel is solvently welded to itself.

3. The urn vault of claim 1, wherein more than one of the at least one side panel are solvently welded to each other.

4. The urn vault of claim 1, wherein the bottom edge of the at least one side panel is solvently welded to the top side of the base panel.

5. The urn vault of claim 1, wherein at least one of the at least one side panel, the top enclosure panel, the base panel, and the at least one guide rail consist of a transparent or translucent polymer.

6. The urn vault of claim 5, wherein the transparent or translucent polymer is colored.

7. The urn vault of claim 5, wherein the transparent or translucent polymer is acrylic.

8. The urn vault of claim 1, wherein the at least one side panel comprises at least one handle for transporting the urn vault.

9. The urn vault of claim 1, wherein the top enclosure panel comprises at least one handle for transporting the urn vault.

10. The urn vault of claim 1, wherein the urn vault comprises at least one pedestal foot solvently welded to the bottom side.

11. The urn vault of claim 1, wherein a cross section of the enclosure for receiving the cremation urn is circular, oval, triangular, pentagonal, or hexagonal.

12. A cremation urn burial vault system comprising:

an urn vault housing at least one urn in a sealed environment within the urn vault, wherein the sealed environment comprises:

at least one side panel, wherein each the side panels comprises an interior surface and an exterior surface;

a top enclosure panel solvently welded to the at least one side panel;

a base panel comprising a top side and a bottom side, wherein the at least one side panel, top enclosure panel, and base panel is at least partially transparent; and at least one guide rail solvently welded to the top side of the base panel;

wherein the interior surface of the at least one side panel is configured for sealing mating engagement with the at least one guide rail.

13. The cremation urn burial vault system of claim 12, wherein the at least one side panel comprises at least one handle for transporting the urn vault.

14. The cremation urn burial vault system of claim 12, wherein the top enclosure panel comprises at least one handle for transporting the urn vault.

15. The cremation urn burial vault system of claim 12, wherein the urn vault comprises at least one pedestal foot solvently welded-to the bottom side.

16. A method of making an urn vault, the urn vault configured to contain a cremation urn, said method comprising:

forming at least one first vault structural member of polymeric material, wherein the first vault structural member is formed through solvently welding at least one side panel to another of the at least one side panel and solvently welding the at least one side panel to a top enclosure panel, wherein each of the side panels comprises an interior surface and an exterior surface;

forming at least one second vault structural member of polymeric material, wherein the second vault structural member is formed through solvently welding at least one guide rail to a top side of a base panel, wherein the at least one second vault structural member is configured for sealing mating engagement with the at least one first vault structural member; and assembling the at least one first vault structural member in mating engagement with the at least one second vault structural member to define there between an interior space for receiving the cremation urn, wherein the interior surface of each of the side panels contacts an exterior side of the at least one guide rail when the at least one first vault structural member is in mating engagement with the at least one second vault structural member.

17. The method of claim 16, further comprising sealing the assembled at least one first vault structural member and at least one second vault structural member by application of solvent to form solvent welds between portions of the assembled at least one first vault structural member in mating engagement with the at least one second vault structural member.

18. The method of claim 16, wherein the forming comprises forming the second vault structural member through solvently welding at least one pedestal foot to a bottom side of the base panel.

* * * * *